US009073333B2

(12) United States Patent
Campbell

(10) Patent No.: US 9,073,333 B2
(45) Date of Patent: Jul. 7, 2015

(54) PRESSURE REGULATION SYSTEM

(75) Inventor: Nicholas John Campbell, Cambridge (GB)

(73) Assignee: Inca Digital Printers Limited (GB)

( * ) Notice: Subject to any disclaimer, the term of this patent is extended or adjusted under 35 U.S.C. 154(b) by 0 days.

(21) Appl. No.: 14/131,054

(22) PCT Filed: Jun. 26, 2012

(86) PCT No.: PCT/GB2012/051492

§ 371 (c)(1),
(2), (4) Date: Jan. 15, 2014

(87) PCT Pub. No.: WO2013/007978

PCT Pub. Date: Jan. 17, 2013

(65) Prior Publication Data

US 2014/0125720 A1 May 8, 2014

(30) Foreign Application Priority Data

Jul. 8, 2011 (GB) ..... 1111701.7

(51) Int. Cl.
*B41J 2/175* (2006.01)
*B41J 2/165* (2006.01)

(52) U.S. Cl.
CPC ..... *B41J 2/17556* (2013.01); *B41J 2/17596* (2013.01); *B41J 2002/16597* (2013.01); *B41J 2/1652* (2013.01); *B41J 2/16526* (2013.01); *B41J 2/175* (2013.01)

(58) Field of Classification Search
CPC ..... B41J 2/17556; B41J 2/17596; B41J 2002/16597; B41J 2002/1652; B41J 2002/16526; B41J 2/1652; B41J 2/175; B41J 2/16526
USPC ..... 347/85
See application file for complete search history.

(56) References Cited

U.S. PATENT DOCUMENTS

| | | | | |
|---|---|---|---|---|
| 5,910,810 | A * | 6/1999 | Brooks et al. | 347/88 |
| 6,290,343 | B1 * | 9/2001 | Lewis et al. | 347/85 |
| 6,315,402 | B1 * | 11/2001 | Kawase | 347/85 |
| 6,428,156 | B1 | 8/2002 | Waller et al. | |
| 6,637,872 | B2 * | 10/2003 | Ara et al. | 347/85 |
| 8,201,931 | B2 * | 6/2012 | Akatsuka et al. | 347/85 |
| 8,256,855 | B2 * | 9/2012 | Yamada | 347/7 |
| 8,430,490 | B2 * | 4/2013 | Morita | 347/92 |
| 2008/0238979 | A1 | 10/2008 | Umeda | |
| 2009/0122093 | A1 * | 5/2009 | Mutoh | 347/7 |
| 2009/0267976 | A1 | 10/2009 | Lee et al. | |

FOREIGN PATENT DOCUMENTS

| | | | |
|---|---|---|---|
| EP | 1177103 | A1 | 2/2002 |
| EP | 1997639 | A1 | 12/2008 |
| JP | 2003300331 | A | 10/2003 |
| WO | 0068018 | A1 | 11/2000 |

OTHER PUBLICATIONS

International Search Report and Written Opinion for Application No. PCT/GB2012/051492 dated Oct. 1, 2012.

* cited by examiner

*Primary Examiner* — Julian Huffman
(74) *Attorney, Agent, or Firm* — Lerner, David, Littenberg, Krumholz & Mentlik, LLP

(57) ABSTRACT

A pressure regulation system for a high throughput inkjet printer uses a peristaltic pump to provide a meniscus vacuum to the printheads. A peristaltic pump is a small and inexpensive device which can produce a low flow rate suitable for achieving the relatively small meniscus vacuum required by drop on demand systems. Furthermore the pump can operate in both directions, and seals in the event of power loss.

13 Claims, 3 Drawing Sheets

PRESSURE REGULATION SYSTEM

This invention relates to a pressure regulation system. In particular, the invention relates to a pressure regulation system that may be used in an inkjet printer.

There is a requirement to feed ink to an inkjet printhead of the 'drop on demand' type at a regulated pressure, known as the meniscus vacuum. Commonly the ink pressure is regulated so as to maintain the meniscus vacuum when a printhead is in use. In some systems it is also a requirement to carry out a purge of the printheads, and therefore the pressure may also be controllable to provide a purge pressure.

Small desktop printers usually apply the pressure control in a disposable inkjet cartridge. In this case ink is never added to the cartridge but only removed, and thus a passive pressure regulation system such as a bubble generator may be used. In a high throughput system however, ink is generally added to a reservoir from a bulk supply. Thus the ink pressure is controlled by controlling the pressure in the reservoir.

One method of maintaining the required pressure is to control the height of the ink in the reservoir in relation to the printhead. However with this method the required location of the reservoir can be inconvenient. Other systems involve the use of a vacuum system communicating with the reservoir. Such a system is described in EP1177103. Many such systems require an isolation valve between the vacuum system and the reservoir to prevent leakage of ink in case of loss of power to the system. They also require a valve to atmosphere to achieve any increase in pressure which is required, for example due to temperature fluctuations.

A suitable pump for use in such a system is a diaphragm pump. Diaphragm pumps produce large and high frequency pressure fluctuations and so need to be attenuated by a damping system so as to avoid disruption of jet breakoff. Thus secondary pressure regulation or a large buffer tank is required to even out pressure fluctuations.

The present invention aims to provide a simplified system for regulating pressure.

According to the present invention, there is provided a pressure regulation system for an inkjet printer comprising: a gas conduit having an outlet communicating with an ink reservoir for supplying ink to a printhead; a pressure sensor arranged to sense fluid pressure in the conduit; a peristaltic pump arranged to pump gas between a gas source and the gas conduit to alter the pressure in the conduit; and a controller arranged to control the pressure in the conduit by receiving an output from the sensor and controlling operation of the pump in response to the output of the sensor.

The gas is preferably air, and the gas source may thus simply be a vent to atmosphere, preferably having a filter.

The system may control the pressure in the conduit, and thus the ink reservoir, between predetermined limits to maintain required meniscus pressure by operation of the peristaltic pump. Usually the reservoir is arranged to supply ink to a plurality of printheads, and may be located near or integrated into the printheads.

For completeness it is noted that peristaltic pumps have been used in some printer devices, such as that described in US-A1-2009/0267976, to feed ink from the ink tank to the printhead and, as described in U.S. Pat. No. 6,428,156, to directly control the ink supplied to the printhead. However, in this prior art, such pumps are used only to pump the ink itself directly. In contrast, the present system uses a peristaltic pump for a different function to control the meniscus pressure at the printheads. To do this, a peristaltic pump is used in the invention to pump a gas such as air to change the pressure in the conduit supplying ink to the printhead.

The claimed arrangement is not disclosed or anticipated in the prior art and provides significant and surprising advantages, as set out below.

Peristaltic pumps are small and inexpensive devices which have a relatively low power consumption, and are particularly useful in battery-backed applications.

Furthermore, peristaltic pumps may operate at a low flow rate such that the pump output may be applied directly to the printheads. This removes any need for secondary pressure regulation, and furthermore the ink reservoir may be relatively small since a large buffer tank is not needed to deal with pressure fluctuations. If required, the conduit may comprise a buffer chamber, and this may be relatively small.

Also prior art vacuum systems have to be carefully designed to ensure that in the event of a fault causing ink to overfill, ink is prevented from entering the pump since this would cause damage to the components. For example a system of valves and filters is required. This is not necessary when using a peristaltic pump, which is resistant to damage if ink accidentally enters the conduit.

Another advantage of using a peristaltic pump is that, in normal use, the pump need operate only to adjust the pressure in the conduit when required, and the pressure is otherwise maintained when the pump is not operating.

Additionally, a peristaltic pump may be operated in either direction and therefore may be used either to reduce or increase pressure in the conduit, such that a separate valve to atmosphere is not required. Moreover, the pump provides a seal against atmosphere in the event of power loss, such that an isolation valve is not required.

A further advantage is that the pump is a volumetric device which can be used to carry out a volumetric purge of the printheads, which may be required as regular maintenance to remove air from the internal passages of the printhead, to recover individual jets, and also to prime the heads when ink is first applied. Thus with the system in equilibrium at the correct meniscus pressure, the pump may be operated to add a predetermined volume to the system. This volume may for example be substantially equivalent to the internal volume of the printheads. This will cause a volume of ink to flow, or purge, through the printhead(s), and any air bubbles to be pushed through the head, until the pressure has reduced back to the meniscus pressure.

Furthermore the volumetric operation of the pump can be measured in order to detect leaks or over-filling by monitoring the required pump duty to achieve the required vacuum and comparing this to predetermined expected pump duty. The expected pump duty may be determined simply by monitoring normal operation of the system.

Where the gas source is a connection to atmosphere, the peristaltic pump may be connected between the conduit and atmosphere. The pump conveniently comprises a substantially circular or part-circular pump casing containing a flexible tube. The pump may for example comprise a rotor with a plurality of rollers, e.g. three which compress the tube against the casing. The conduit may simply be a further length of tubing and may be connected directly to the reservoir, and on the other side of the pump the tubing may be connected or open to atmosphere, optionally via a filter.

The reservoir may have an ink supply communicating therewith, and the controller may additionally control the supply of ink to the reservoir, for example in response to a level sensor in the reservoir in a known manner. For example, the ink supply is switched on when the ink level falls below a predetermined lower limit, and is switched off when the level reaches a predetermined upper limit. The supply rate is at least as fast as the maximum expected rate of ink usage.

Advantageously, the ink supply is controlled in such a manner as to produce minimal pressure fluctuations, such that the supply and use of ink in the reservoir does not cause the pump to operate to correct the pressure.

In order that the invention may be more readily understood, reference will now be made, by way of example, to the accompanying drawings, in which.

Figure 1:
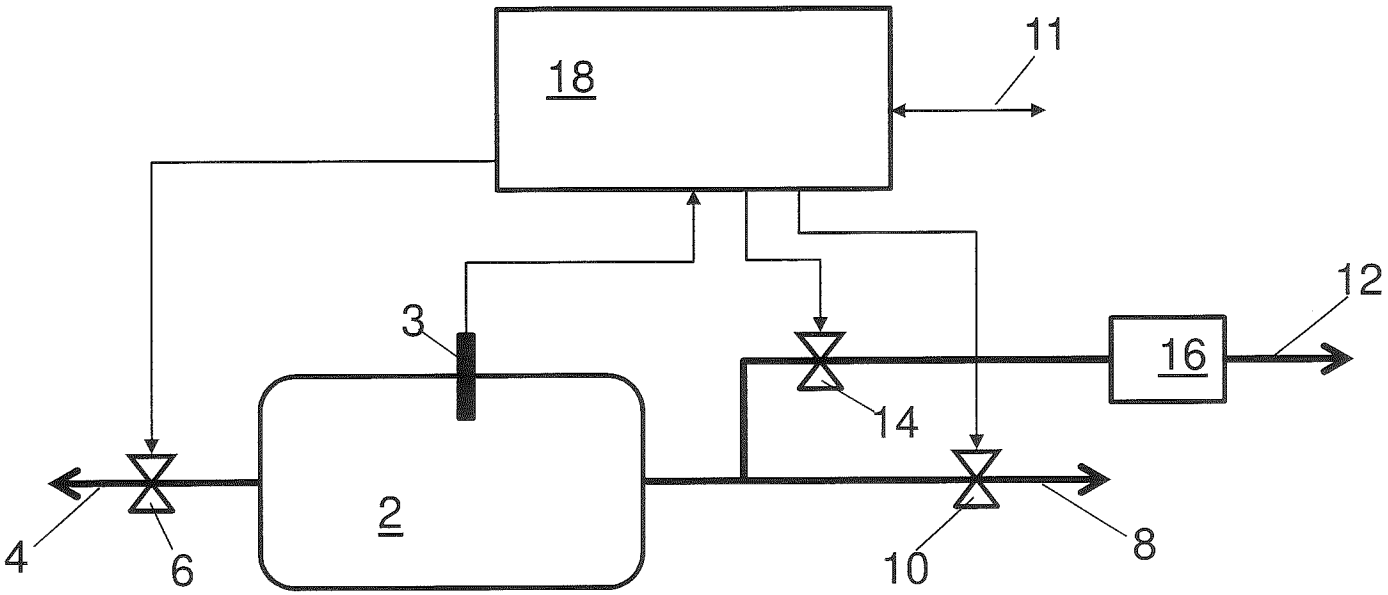
Fig. 1 PRIOR ART
FIG. 1 is a schematic diagram of a prior art pressure regulation system for an inkjet printer.

Referring to FIG. 1, a prior art pressure regulation system includes a buffer chamber 2 which generally contains air. The chamber 2 is provided with a pressure sensor 3, and has an outlet 4 for connection to a printhead ink reservoir, (not shown) of an inkjet printer. An isolation valve 6 is provided between the chamber and the ink reservoir. The chamber 2 also communicates with a vacuum source 8 such as a pump via a vacuum valve 10 provided between the vacuum source 8 and the chamber 2. The chamber also communicates with the atmosphere 12 via an atmosphere valve 14, and a filter 16 may also be provided between the connection to atmosphere 12 and the atmosphere valve 14 to prevent impurities entering the system.

A controller 18 is arranged to receive an output of the pressure sensor 3 in the chamber 2. The controller 18 is also arranged to operate the isolation, vacuum and atmosphere valves 6, 10 and 14. In operation of the printheads, the controller receives the output of the pressure sensor 3, and determines whether the pressure in the chamber 2 corresponds to the predetermined required meniscus vacuum pressure.

In the event that the sensed pressure is higher than the required pressure, the controller opens the vacuum valve 10 connecting the chamber with the vacuum source 8. When the required pressure is reached, the controller operates the vacuum valve to close the connection with the vacuum source 8. If the pressure is too low, for example because of temperature fluctuations in the chamber, the controller operates the atmosphere valve 14 connecting the chamber 2 to atmosphere to increase the pressure until the required gauge pressure is reached. The controller 18 may also operate the isolation valve 6 to close the outlet 4 in the event of a power failure. The controller 18 also includes a connection to an external control system 11, which may enable parameters of the system to be set externally and through which data relating to the pressure regulation system may be output.

It will be appreciated that the operation of the vacuum and atmosphere valves can cause large and/or high frequency pressure variations, and thus the chamber 2 must be large enough to act as a buffer for such fluctuations. Alternatively secondary pressure regulation can be provided.

Figure 2:
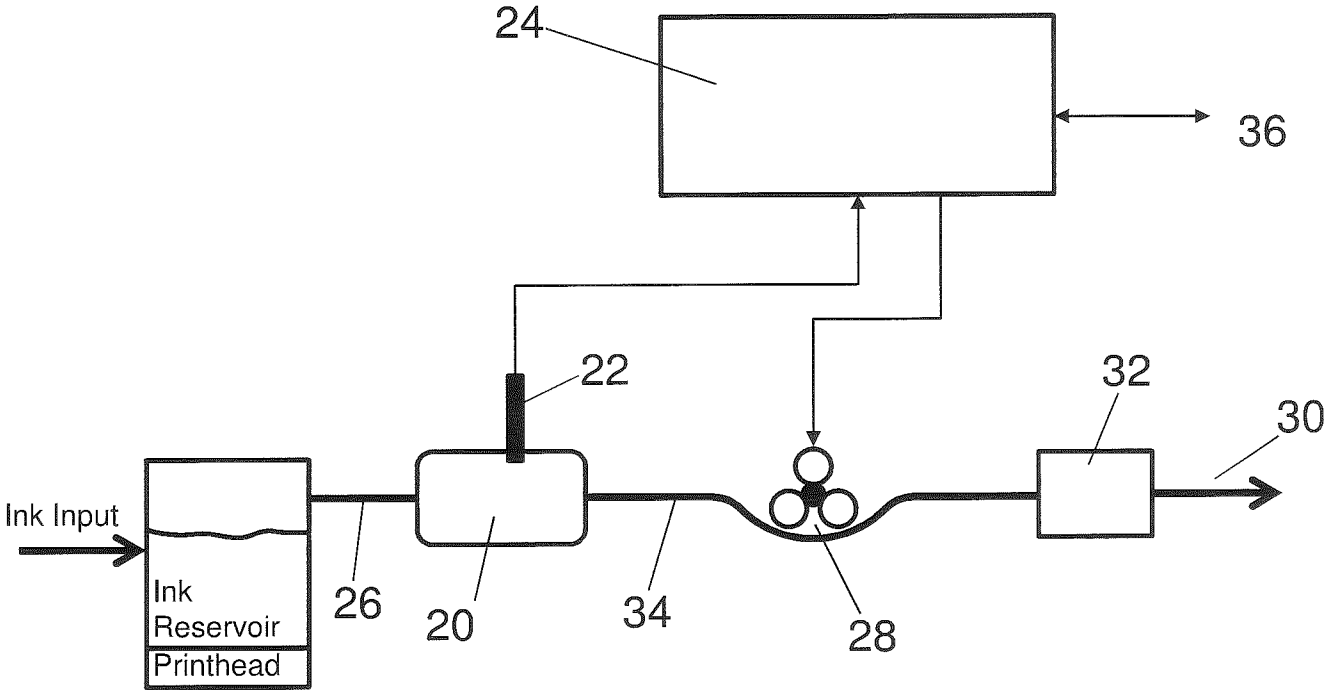
FIG. 2 is a schematic diagram of a pressure regulation system according to the invention.

Referring now to FIG. 2, the system of the invention includes a gas conduit 34 including a buffer chamber 20, which conveniently contains air. A pressure sensor 22 is arranged to sense pressure in the conduit 34, and is conveniently located in the chamber 20. A controller 24 is arranged to receive an output of the sensor 22. The controller may also be connected to an external control system 36 as described above. The sensor may for example be a calibrated temperature compensated silicon pressure sensor arranged to detect the vacuum level in the chamber 20 relative to atmosphere. The chamber 20 has an outlet 26 for direct connection to the printhead ink reservoirs.

Figure 3:
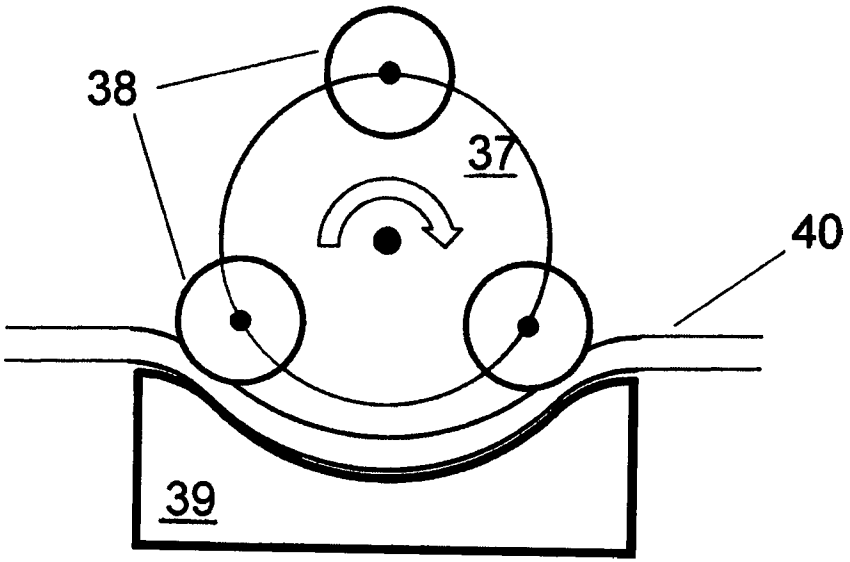
FIG. 3 is a diagram of a peristaltic pump for use in the system of FIG. 2.

A peristaltic pump 28 is provided between the conduit 34 and a connection to atmosphere 30 via a filter 32. The conduit 34 and the connection to atmosphere 30 may preferably each comprise a length of tubing which also runs through the pump 28, such that the pump is arranged to pump air to or from the chamber to alter the pressure. As shown in FIG. 3, the peristaltic pump 28 has a generally part-circular pump casing or backing plate 39 with a length of tubing 40 fitted within the casing. A rotor 37 can be turned in either direction by a motor, and has rollers 38 (for example three) mounted around it which compress the flexible tubing 40 against a shaped backing plate 39. As the rotor turns, the part of tube under compression closes, forcing air to move through the tube. Additionally, as the tube opens to its natural state after the passing of cam, air flow is induced to the pump.

It will be appreciated that the peristaltic pump 28 may run in either direction, and thus may operate to increase or to decrease the pressure in the chamber 20. The resistance to movement of the rotor may also be such that the pump 28 provides a seal against atmosphere when it is not running, such as in the event of a power loss. The controller 24 is arranged to operate the pump 28 in response to an output of the sensor 22 to maintain the pressure in the chamber between predetermined limits corresponding to the meniscus vacuum suitable for operation of the printheads.

In use in a first mode corresponding to operation of the printheads, the controller 24 receives an output from the sensor 22, compares this with the predetermined acceptable pressure range, and if necessary runs the peristaltic pump 28 in the required direction to maintain the required vacuum in the chamber 20.

Typical meniscus vacuum levels required in a drop on demand inkjet printer are of the order of 20 mbar. This is a small fraction of atmospheric pressure, and can be provided by a pump with a relatively low throughput. For example, a pump with a capacity of 20 ml per minute can achieve a reduction of pressure of 20 mbar in a 1 liter volume in one minute. A small peristaltic pump may operate at such flow rates, and so is suitable for generating meniscus vacuum.

The inherent volume of the conduit 34 between the pump 28 and the chamber 20 may provide a buffer volume suitable for moderating pressure fluctuations from the operation of the pump. Thus the chamber 20 may be relatively small, or may be omitted altogether. In the latter case, the conduit 34 or pump tubing may be connected directly to the ink reservoir, and the pressure sensor may be located to sense the pressure in the tubing.

In a second mode, corresponding to purging of the printheads, the controller may operate to pump to add a required purge volume to the system, which volume may correspond to the internal volume of the printhead. This provides a higher pressure which pushes ink out of the printheads to carry out a volumetric purge of the printheads. This eliminates the need for a separate purge pressure supply. Purging may take place as regular maintenance and upon priming the printheads.

The controller may also be arranged to monitor the pump operation required to maintain the meniscus vacuum. Should the monitored pump duty differ from a predetermined pump duty, this may be indicative of an air leak in the system. The controller may be arranged to provide an output when the values differ, for example to alert a user that an air leak is present in the system so that the leak can be repaired.

The invention claimed is:

1. A pressure regulation system arranged for controlling the meniscus pressure of ink at a printhead of an inkjet printer, wherein the printhead is arranged to operate using ink having a pressure within a predetermined range of meniscus pressure values, the system comprising:

a gas conduit having an outlet arranged to communicate with an ink reservoir for supplying ink to the printhead;

a pressure sensor arranged to sense fluid pressure in the conduit;

a peristaltic pump arranged to pump gas between a gas source and the gas conduit to alter the pressure in the conduit; and a controller arranged to receive an output from the pressure sensor, to determine whether the sensed fluid pressure in the conduit falls within the predetermined range of meniscus pressure values and to control operation of the pump in response to said output of the sensor and said determination to maintain the pressure in the conduit within the predetermined range of meniscus pressure values.

2. The system as claimed in claim 1, in which the peristaltic pump is operable to pump gas in either direction.

3. The system as claimed in claim 1, in which the gas comprises air.

4. The system as claimed in claim 3, in which the gas source is a vent to atmosphere.

5. The system as claimed in claim 1, in which the gas conduit comprises a length of tubing connected between the pump and the ink reservoir.

6. The system as claimed in claim 1, in which the gas conduit comprises a buffer chamber.

7. The system as claimed in claim 1, in which the gas source is a length of tubing connected between the pump and atmosphere.

8. The system as claimed in claim 1, in which the pump comprises a generally circular or part-circular housing, a length of flexible tubing within the housing, and a rotor having a plurality of rollers arranged to compress the tubing against the housing.

9. The system as claimed in claim 1, in which the controller has a first mode corresponding to use of the printer for printing operation, in which the controller is arranged to operate the pump to maintain the pressure in the conduit between predetermined limits.

10. The system as claimed in claim 9, in which the controller has a second mode corresponding to a purge mode for purging of the printheads of the printer, in which the controller is arranged to operate the pump to add a predetermined purge volume to the conduit.

11. The system as claimed in claim 1, in which the controller is arranged to monitor the pump duty required to maintain the pressure in the chamber between the predetermined limits, and to compare the pump duty with a predetermined range representing expected pump duty in normal operation.

12. The system as claimed in claim 1, in which the controller comprises a connection to an external control system.

13. A method of regulating ink pressure by controlling the meniscus pressure of ink at a printhead of an inkjet printer, wherein the printhead operates using ink having a pressure within a predetermined range of meniscus pressure values, the method comprising:

sensing the pressure in a conduit communicating with an ink reservoir for supplying ink to the printhead;

determining whether the sensed pressure is within the predetermined range of meniscus pressure values; and, if not, operating a peristaltic pump to pump gas between a gas source and the conduit to alter the pressure in the conduit to maintain the meniscus pressure value at the printhead within the predetermined range of meniscus pressure values.

* * * * *